United States Patent [19]

Park

[11] Patent Number: 4,512,081

[45] Date of Patent: Apr. 23, 1985

[54] TRAMMEL HEAD ASSEMBLY

[76] Inventor: Hong K. Park, 300 Harolds Dr., Huntsville, Ala. 35806

[21] Appl. No.: 535,640

[22] Filed: Sep. 26, 1983

Related U.S. Application Data

[63] Continuation-in-part of Ser. No. 383,738, Jun. 1, 1982, abandoned.

[51] Int. Cl.[3] ..... B43L 9/04

[52] U.S. Cl. ..... 33/27 C; 33/42; 33/158

[58] Field of Search ..... 33/27 C, 41 F, 42, 484, 33/485, 147 T, 158, 159, 160, 173

[56] References Cited

U.S. PATENT DOCUMENTS

| | | | |
|---|---|---|---|
| 365,031 | 6/1887 | Traut | 33/158 |
| 1,619,750 | 3/1927 | Nelson | 33/158 |
| 2,419,752 | 4/1947 | Zumbuhl | 33/158 |
| 2,466,357 | 4/1949 | Beith | 33/42 |
| 2,621,412 | 12/1952 | Slusher, Jr. | 33/158 |
| 3,589,013 | 6/1971 | Colon | 33/27 C |

*Primary Examiner*—Richard R. Stearns

*Attorney, Agent, or Firm*—C. A. Phillips; Michael L. Hoelter

[57] ABSTRACT

A trammel assembly consisting of a trammel head and a controllably dimensioned flat scale. This trammel head contains opposite pairs of guide regions for receiving variously sized scales and for tightening these scales in place.

12 Claims, 15 Drawing Figures

22
20
18
21
24
10
110
12
14
26
34
36
38
35
44
32
30
33
37
28
39

80
86
84
82

80
94
96
90
92

80
88
84
82

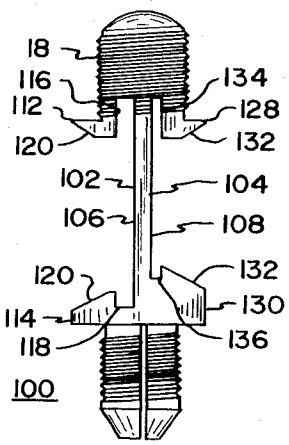
FIG. 13
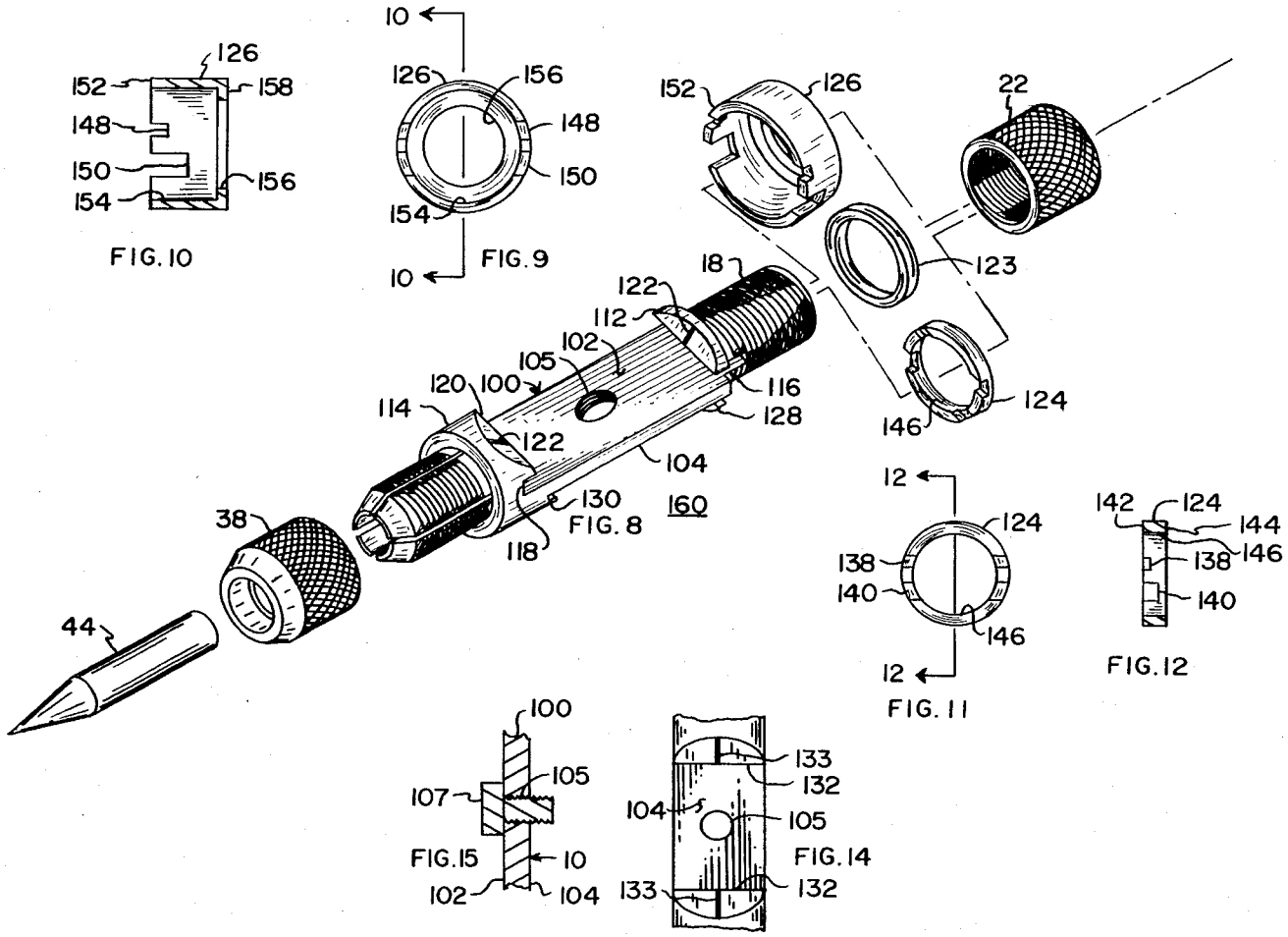
FIG. 8
FIG. 9
FIG. 10
FIG. 11
FIG. 12
FIG. 14
FIG. 15

TRAMMEL HEAD ASSEMBLY

This application is a continuation-in-part of application Ser. No. 383,738, now abandoned, filed June 1, 1982.

TECHNICAL FIELD

This invention relates generally to devices for precision marking of work surfaces, and particularly to marking devices employing what is generally referred to as trammel points.

BACKGROUND ART

In both metal and wood construction work, it is frequently necessary to make precise markings or measurements related to a reference point or reference surface, and for this purpose, devides typically referred to as trammel points are employed. A trammel point is a sharp pointed instrument held by a trammel point holding head, in turn adapted to be clamped onto a beam. By this combination, a mark on the material may be referenced. The difficulty with existing trammel heads, or trammel head assemblies, is that they lack the necessary versatility to enable quick referencing from one point to another and the holding of different types of styli.

Accordingly, it is the object of this invention to provide an improved trammel head assembly which overcomes these difficulties.

SUMMARY OF THE INVENTION

In accordance with this invention, a trammel assembly is constructed wherein a trammel head is formed with opposite flat supporting guides which encompass a portion of variously sized flat scales. One end region of the trammel assembly is formed having a clamping ring assembly which, by means of being threaded onto the trammel assembly, presses against and rigidly holds a scale in place.

BRIEF DESCRIPTION OF THE DRAWINGS

FIG. 8 is an exploded pictorial view of an alternate assembly to that shown in FIG. 1.

FIG. 9 is an end view of a collar forming a portion of the assembly as illustrated in FIG. 8.

FIG. 10 is a sectional view taken along line 10—10 of FIG. 9.

FIG. 11 is an end view of a collar forming a portion of the assembly as illustrated in FIG. 8.

FIG. 12 is a sectional view taken along line 12—12 of FIG. 11.

FIG. 13 is a side view of the central body of the trammel head as shown in FIG. 8.

FIG. 14 is a cut-away view of a portion of the trammel assembly illustrated in FIG. 8.

FIG. 15 is a cut-away view illustrating the central opening through the trammel head.

DETAILED DESCRIPTION OF THE DRAWINGS

Figures 1, 5, 6, 7:
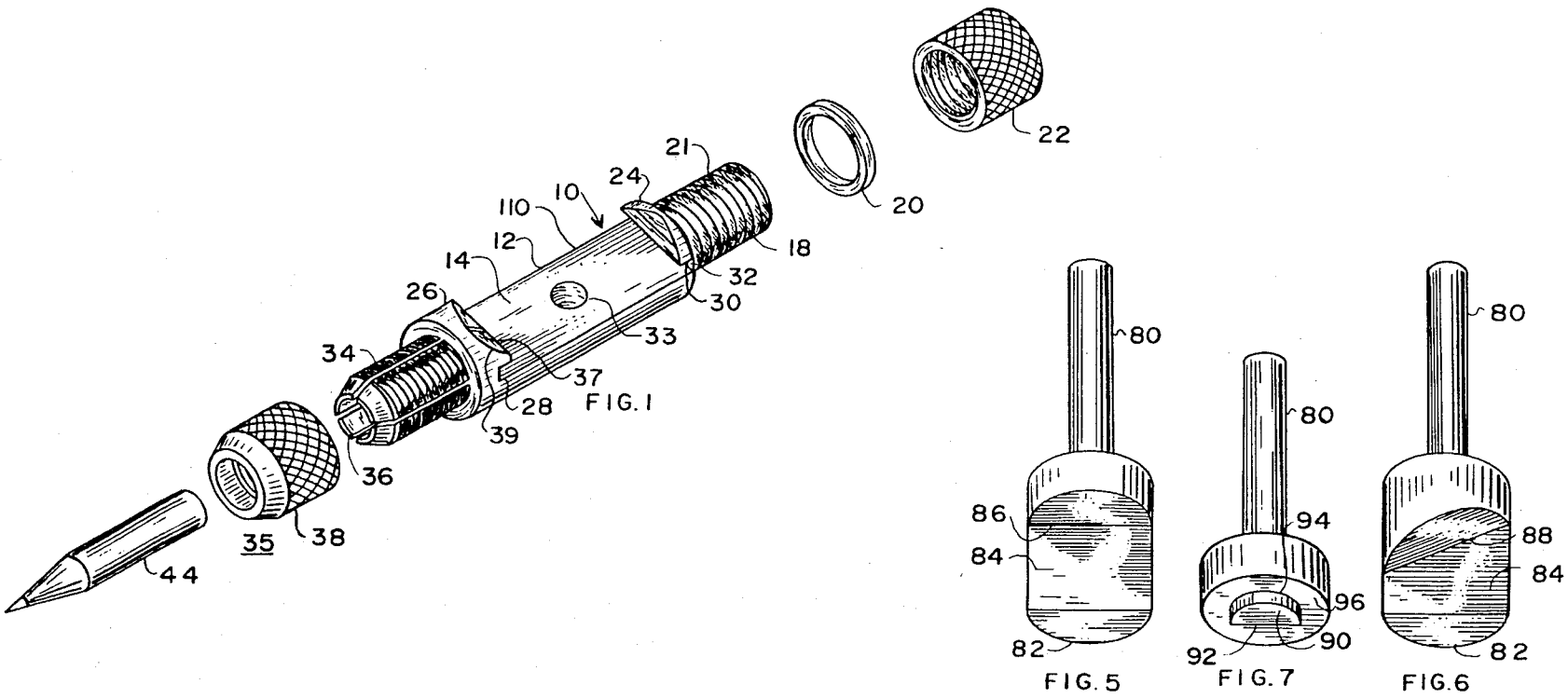
FIG. 1 is an exploded pictorial view of an assembly constructed in accordance with this invention.
FIGS. 5–7 are pictorial views of alternate forms of trammel head devices.
Figure 2:
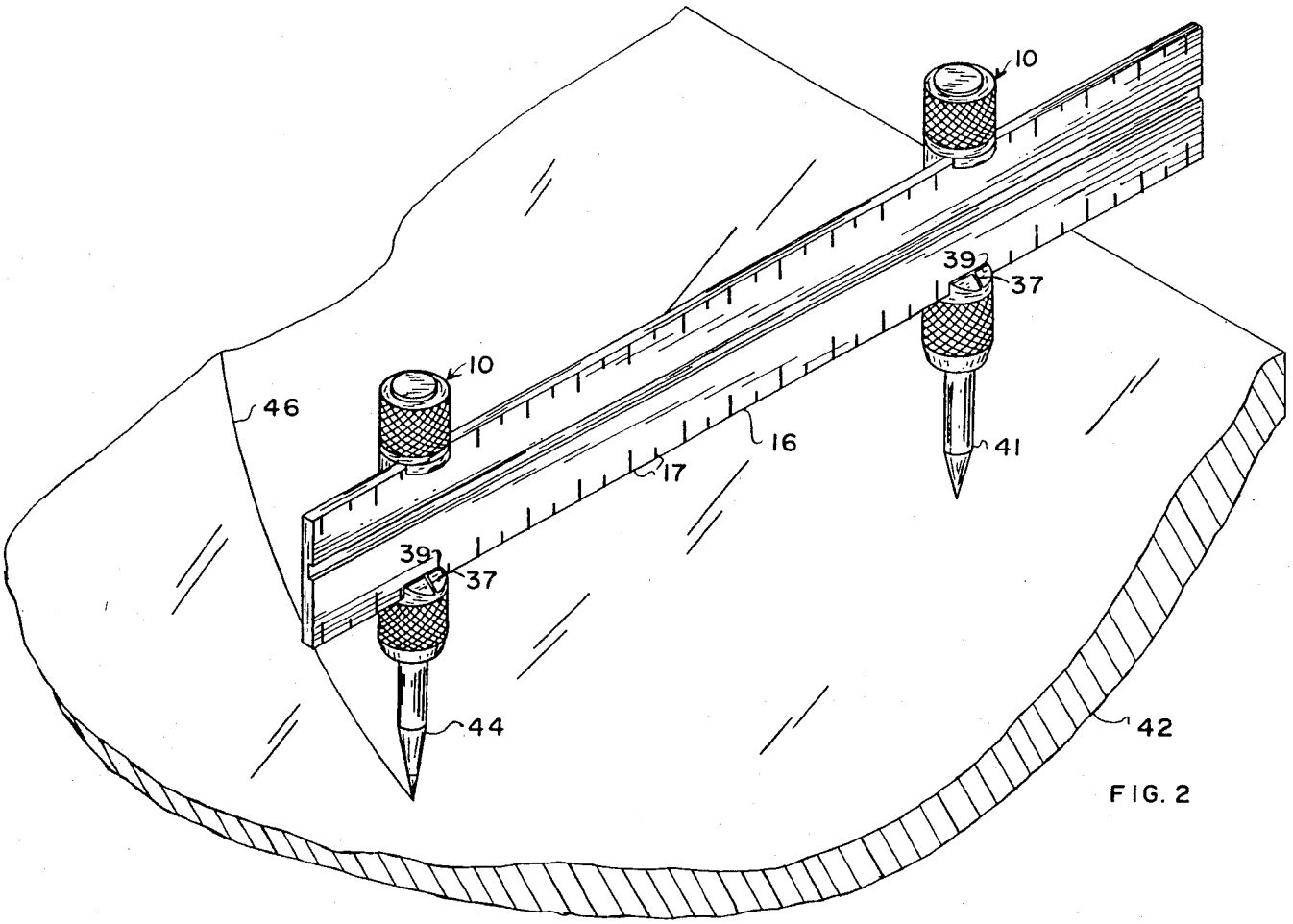
FIG. 2 is a pictorial view of a trammel head assembly as contemplated by the present invention.
Figure 4:
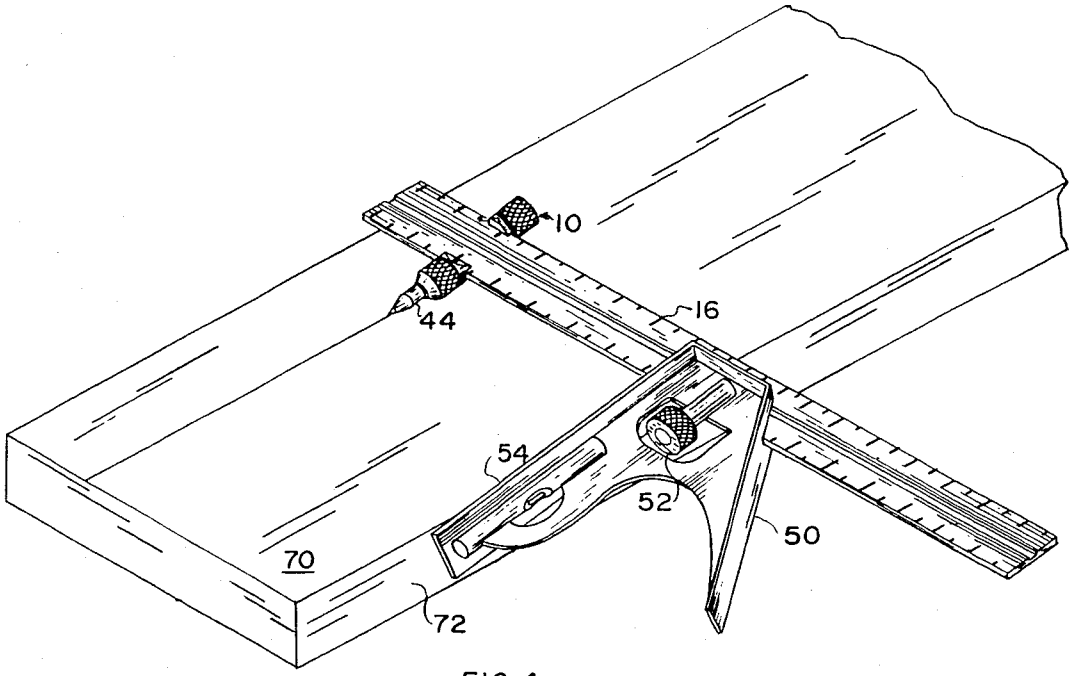
FIGS. 3 and 4 are pictorial views of alternate embodiments of the assembly shown in FIG. 2.
Figure 3:
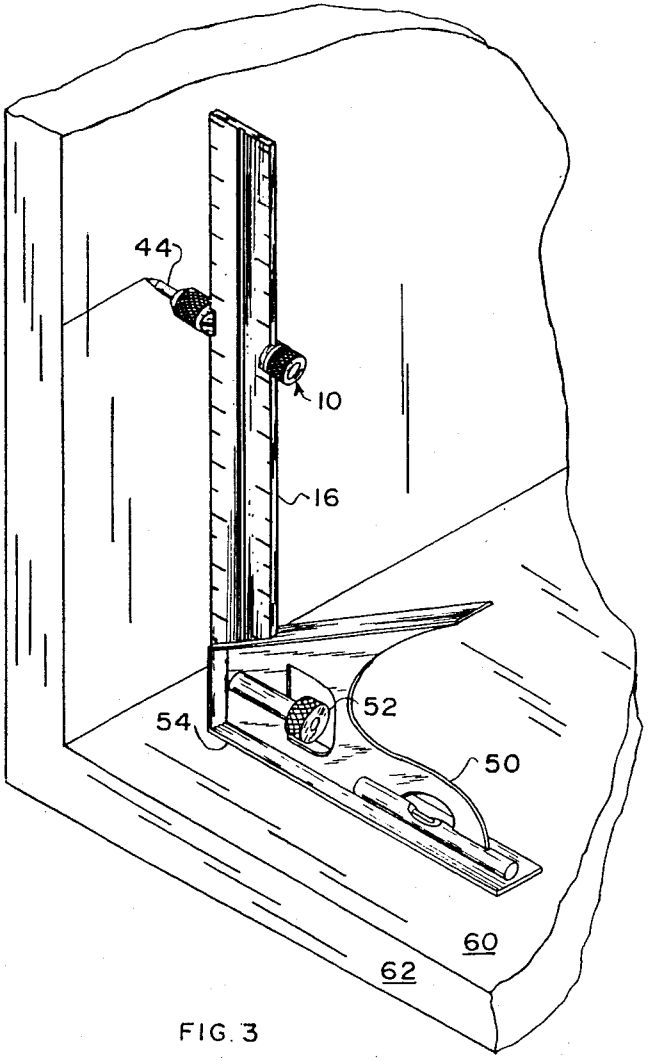

Referring initially to FIG. 1, a trammel head 10 is constructed with a central body 12 which has a planar region 14 adapted to receive a metallic scale 16, illustrated in FIGS. 2–4. A first threaded region 18 extends from one end of central body 12 and supports a collar 20 and clamping nut 22. Oppositely positioned lips 24 and 26 form a pair of oppositely positioned slots 28 and 30 to provide a track or guide which will slidably receive scale 16. Scale 16 has conventional indices 17 constantly spaced along the rule and typically dimensionally labelled using a metric or English system of measurement (not shown). Lip 24 is formed with a circular indentation 32 to enable ring or collar 20 to extend over a portion of lip 24 and thus extend outward of and around a portion of slot 30. With a scale in place, as shown in FIGS. 2–4, threaded nut member 22 threads over threads 21 and thereby forces collar 20 inward against the scale to lock it in place at a selected longitudinal position. An opening 33, normal to and through central body 12, enables the attachment to a threaded rod at a right angle to planar surface region 14. A hollow tubular member 34 extends from the opposite end of central body 12, and it has a threaded exterior which has four slots to enable its compression so that it functions as a chuck. Thus, hollow opening 36 is adapted to receive a stylus 44 of any selected type which is adapted to fit within opening 36. A threaded collar member 38 is adapted to thread over tubular member 34 to form a chuck 35 and thus, with a stylus in place, effects a tightening and holding of the stylus. While a pointed stylus is illustrated, which may be a pencil or steel point, a variety of stylus members, or reference guides adapted to reference to different shaped surfaces, may also be inserted and held by tubular member 34, as will be further discussed. The center line of a stylus is referenced by reference index 37 on a tapered face 39 of central body 12, enabling the stylus to be referenced to an indice 17 on scale 16.

FIG. 2 illustrates the employment of two of the trammel head assemblies shown in FIG. 1 wherein trammel head 10 holds a point 41 adapted to rest at a selected point on a workpiece 42, and stylus member 44 is, in this case, illustrated as a pencil and is shown making a mark 46 on workpiece 42 in the form of a circle.

FIG. 3 illustrates a trammel head assembly 10 wherein a squaring handle 50 is attached to scale 16 by an adjustable clamp 52 and provides a right angle surface 54 to enable the drawing of a line by a stylus 44 parallel to a surface 60 on workpiece 62. Additionally, this combination of handle 50 and stylus 44 enables the accurate measurement of the distance between surface 60 and a point on surface 61.

FIG. 4 illustrates a similar combination to that shown in FIG. 3 wherein the squaring handle 50 is reversed, and reference surface 54 of handle 50 is adapted to move along one surface of workpiece 70 and thereby to enable stylus 44 to make a mark on a surface of workpiece 70 which is parallel to the surface, and the line made is of constant distance from surface 72. Additionally, the distance between surface 72 and a previously made make on surface 73 can be measured.

FIGS. 5–7 illustrate alternate forms of trammel head devices for effecting a reference to a work surface. The upper or shank ends 80 of each enable the device to be gripped by chuck 35. The outer surface 82 of the device shown in FIG. 5 is curved to enable a relatively fine area of engagement with an inside surface of a workpiece, and the flat portion 84 is adapted to engage an outside surface.

FIG. 6 illustrates a modification of this structure wherein the outside curved surface 82 is the same as shown in FIG. 5, but instead of having a horizontal cut region 86 as shown in FIG. 5 to form an edge for the flat portion 84, the boundary edge region 88 is positioned at an angle between vertical and horizontal, this facilitating the orientation of the device other than horizontal.

The trammel device shown in FIG. 7 is a variation of the one shown in FIG. 5 and particularly differs in that the work region 90, which effects a first work reference surface 92 for an outside dimension and a second work reference surface 94 for an inside dimension, is of reduced depth and thus particularly adapted to be employed with sheet metal as a work material. Further, there is provided a reference surface 96 normal to the axis of the other engaging surfaces for resting on a workpiece.

FIGS. 8 and 13 illustrate an alternate embodiment to that shown in FIG. 1. As illustrated, central body 100 is configured having opposite sides 102 and 104 having therein planar regions 106 and 108, respectively. Opening 105 is centrally positioned in planar region 106 and extends through central body 100. Opening 105 is threaded, and a set screw 107 threads through this opening and extends beyond an opposite side of central body 100. Side 102 is configured similar to side 110 of trammel body 12 as shown in FIG. 1 and is adapted to receive a scale alongside planar region 106 between oppositely positioned lips 112 and 114. These lips 112 and 114 form upper and lower slots 116 and 118 which provide a track or guide for the inserted scale. Each lip 112 and 114 has a tapered face 120 which contains a reference index 122 therein. This reference index 122 enables stylus 44 to be referenced to an index on the scale. Upper lip 112 projects outward beyond threaded region 18 to form a stop for rings or collars 123, 124 and 126. Collar 123 is identical to collar 20 described above. Collars 124 and 126, when positioned against lip 112, extend around a portion of upper slot 116 that projects partially into threaded region 18 of central body 100.

Opposite side 104 of central body 100 is configured similar to side 102 except that side 104 is adapted to receive a thinner, narrower scale. Side 104 contains lips 128 and 130 on opposite sides of planar region 108, and each lip 128 and 130 has a tapered face 132 which contains a reference index 133 (FIG. 14) therein. This reference index also enables stylus 44 to be referenced to an index on the inserted scale. Upper lip 128 also projects outward beyond threaded region 18 as does opposite lip 112 to form a stop for rings or collars 124 and 126. Lips 128 and 130 form upper and lower slots 134 and 136 which are thinner than slots 116 and 118 of side 102. Slots 134 and 136 provide a track or guide for an inserted thinner scale. Upper slot 134 extends into threaded region 18 approximately the same distance as does upper slot 116 of side 102. Since a thinner scale generally has a smaller width than a thicker scale, planar region 108 in side 104 has a longitudinal length less than that of planar region 106 in side 102.

FIG. 8 illustrates three separate collars 123, 124 and 126, their use being dependent upon the width of the scale inserted within central body 100. Collar 123 is for use with a standard scale, while collar 124 is for use with what will be termed a wide scale, and collar 126 is used for what will be termed a narrow scale. The cross sectional thickness of these wide and narrow scales determine whether it is to be inserted within thicker slots 116 and 118 adjacent to planar region 106 or within thinner slots 134 and 136 adjacent to planar region 108. Thus, central body 100 is adapted to receive wide scales which may have a thick or thin cross sectional area or narrow scales which may have a thick or thin cross sectional area. Additionally, central body 100 is adapted to receive standard size scales by utilizing collar 123.

Collar 124 (FIGS. 9 an 10), to be used with what is termed wide scales, is an annular ring having two pairs of spaced notches 138 and 140 cut in end region 142. Opposite end region 144 is planar similar to collar 20 of FIG. 1 and functions in a similar manner. Notch pairs 138 and 140 may be cut having the same or different depths, but notch pair 138 is cut having a notch thickness the same as slot 134. Notch pair 138 is positioned in collar 124 so as to form an extension of upper slot 134, and notch pair 140 is positioned in collar 124 so as to form an extension of opposite upper slot 116. Thus, each notch of both notch pairs 138 and 140 are positioned flush with their respective slots 134 and 116. Depending upon the cross sectional thickness of the scale inserted within central body 100, either notch pair 138 or 140 will engage a portion of this scale. Thus, there is a pair of thick notches to be incorporated with thick wide scales and a pair of thin notches to be incorporated with thin wide scales.

The inner periphery surface 146 of collar 124 is sized to enable collar 124 to slip over threaded region 18 and to rest against lips 112 and 128, respectively. Collar 124 thus extends outward of and around a portion of upper slots 116 and 134. Once collar 124 and the proper notch pairs 138 or 140 engage the scale, nut 22 is threaded onto central body 100 and presses or clamps collar 124 against this wide scale, thereby restraining the scale in place.

Alternate collar 126 (FIGS. 11 and 12), as previously discussed, is utilized with what is termed a narrow scale, whether it is of thick or thin cross sectional area. This collar 126 is configured with notch pairs 148 and 150 in end region 152. These notch pairs 148 and 150 are similar to the previously mentioned notch pairs 138 and 140 in that they may be cut to the same or different depths. Notch pair 148 is cut having a notch thickness the same as slot 134, while notch pair 150 is cut having a notch thickness the same as slot 116. Thus, there is a pair of thick notches to be incorporated with thick narrow scales and a pair of thinner notches to be used with thin narrow scales. Each notch pair 148 and 150 is cut in end region 152 of collar 126 so as to form extensions of their respective slots 116 and 134. Thus, depending upon the cross sectional thickness of the narrower scale, either notch pair 148 or 150 will properly engage the scale.

Inner periphery 154 of collar 126 in end region 152 is sized greater than the inner periphery 156 of collar 126 in end region 158. This allows end region 152 of collar 126 to slide around and over upper lips 112 and 128 and extend around a portion of planar regions 105 and 108. End region 152 extends past lips 112 and 128 until the narrower scale is positioned within the proper thick or thin notch pairs 148 and 150. The inner periphery 156 of opposite end region 158 of collar 126 is sized similar to the inner periphery 146 of collar 124. This prevents collar 126 from sliding over and around lips 112 and 128. Once the narrower scale is engaged, nut 22 is threaded onto threaded region 18 to clamp the scale within central body 100.

To illustrate the operation of trammel assembly 160, assume, for example, that a user wishes to insert a scale that has a thin cross sectional area into central body 100. Since the scale is thin, it may be inserted adjacent to either planar region 106 or 108 so that the deciding factor as to which planar region is to be utilized depends upon the width of the scale. If the scale has a width longer than the longitudinal length of planar region 108, then it is inserted within and between slots 116 and 118. If, however, this scale is able to be inserted against the shorter planar region 108, then it is slid within and between slots 134 and 136. Once the proper planar region is selected, either collar 123, 124 and 126 is slid around threaded region 18 to engage this scale. If the scale, as inserted, extends between both the upper and lower lips of the selected planar region, then this wide scale will be inserted within the thin notch pair 138 in collar 124. On the other hand, if the inserted scale does not extend all the way between upper and lower slots in the selected planar region, than alternate collar 126 is required, and this collar will slide over upper lips 112 and 128 until its thin notch pair 148 engages this narrower scale. Otherwise, collar 123 is chosen to be clamped against the scale to hold it in place. Once collar 123, 124 or 126 is in place, nut 22 is rotated around threaded region 18 of central body 100 until it clamps this collar against the scale. Set screw 107 is then threaded into opening 105 to further engage and secure the scale in place.

The same procedure is followed if the user wishes to insert a scale having a thick cross sectional area into central body 100 except that obviously this thick scale will not be able to be inserted within thin slots 134 and 136 adjacent to planar region 108. Otherwise, selection of collar 123, 124 or 126 is determined by the width of this thicker cross-sectional scale as previously discussed. Finally, all the other operations of central body 100 are identical to that of central body 12, as illustrated in FIG. 1.

I claim:

1. A trammel assembly adapted to accommodate variously dimensioned, elongated, generally flat scales having singular cross sections, comprising:

a trammel head assembly comprising:

a central body region having a first inset elongated flat portion and a second oppositely positioned inset elongated flat portion sized smaller than said first portion, each said flat portion being adapted to separately receive a said scale, a first externally threaded region extending from one end of said central body region, and a second externally threaded region extending from an opposite end of said central body region and having a tubular interior, first guide means forming a part of said central body region for guiding a said scale adjacent to said first flat portion, said first guide means comprising a first pair of oppositely spaced lip members positioned adjacent to longitudinal ends of said first flat portion, one of said first pair of lip members forming a first slot extending into said first threaded region flush with said first flat portion, second guide means forming a part of said central body region for guiding a said scale adjacent to said second flat portion, said second guide means comprising a second pair of oppositely spaced lip members positioned adjacent to longitudinal ends of said second flat portion, one of said second pair of lip members forming a second slot extending parallel to said first slot flush with said second flat portion, first clamping means for applying a force parallel to each said flat portions of said central body region and against a said elongated scale, said first clamping means comprising:

a first nut threadably engagable with said first threaded region, and an annular collar extending around said first threaded region and around said slot in said first threaded region, said collar engaging a said scale inserted within one of said slots, wherein said collar and a flat region together engage and secure a said scale, and second clamping means including a second nut threadably engagable on said second threaded region for clamping a workpiece engaging member within said tubular interior;

an index positioned on one lip member of each said pair of lip members and said index coinciding with a plane centrally through said tubular interior; and a workpiece engaging member positioned and held within said tubular interior.

2. A trammel assembly as set forth in claim 1 wherein said second threaded region includes a plurality of longitudinally extending slots, and said second nut comprises a second collar which threadably extends around said second threaded region.

3. A trammel assembly as set forth in claim 1 wherein said annular collar has one end region configured with a first pair of spaced like notches and a second pair of spaced like notches sized differently from said first pair of notches, wherein one said pair of notches and a flat region together engage and secure a said scale.

4. A trammel assembly as set forth in claim 1 wherein said annular collar extending adjacent one of each of said first and second pair of lip members.

5. A trammel assembly as set forth in claim 1 wherein at least one lip member of each said pair of lip members having an inwardly tapering surface in turn including a said index.

6. A trammel assembly as set forth in claim 1 further comprising a guide attachable to a said scale, and said guide having a reference surface extending at a right angle from said scale.

7. A trammel assembly as set forth in claim 1 wherein said central body region has an opening extending therethrough and which is normal to said flat portions.

8. A trammel assembly as set forth in claim 7 wherein said opening is threaded.

9. A trammel assembly as set forth in claim 7 further comprising biasing means for applying a bias through said opening and against a said scale to engage and secure a said scale positioned in one of said guide means.

10. A trammel assembly as set forth in claim 1 wherein said workpiece engaging member comprises a shank end adapted to be inserted within said tubular interior, and an opposite end region having a curved surface portion adapted to be engageable with an interior surface of a workpiece, and a flat portion adapted to make an engaging contact with an outer surface of a workpiece.

11. A trammel assembly as set forth in claim 10 wherein said workpiece engaging member further comprises a reference surface normal to said shank portion.

12. A trammel assembly as set forth in claim 1 further comprising:

a second trammel head assembly comprising:

a central body region having an inset, elongated, flat portion adapted to receive a said scale, a first threaded region extending from one end of said central body region, and a second threaded region extending from an opposite end of said central body region and having a hollow interior, first clamping means adapted to be threaded on said first threaded region for applying a lateral force parallel to said flat portion of said central body region and against a said elongated flat scale, and second clamping means attached to said second threaded region for clamping a stylus member within said hollow interior.

* * * * *